United States Patent [19]

Hinzmann

[11] Patent Number: 4,642,083

[45] Date of Patent: Feb. 10, 1987

[54] METHOD AND APPARATUS FOR MAKING AND MANIPULATING INNER TUBES FOR USE IN DRY CELLS OR THE LIKE

[75] Inventor: Alfred Hinzmann, Weams, Va.

[73] Assignee: Hauni-Richmond, Inc., Richmond, Va.

[21] Appl. No.: 754,622

[22] Filed: Jul. 12, 1985

[51] Int. Cl.[4] ..... B31C 3/02

[52] U.S. Cl. ..... 493/93; 493/109; 493/294; 493/304; 493/308

[58] Field of Search ..... 493/304, 303, 294, 287, 493/108, 109, 93, 308

[56] References Cited

U.S. PATENT DOCUMENTS

| | | | |
|---|---|---|---|
| 1,173,763 | 2/1916 | Baker | 493/93 X |
| 1,195,741 | 8/1916 | Sattley et al. | 493/158 X |
| 1,335,894 | 4/1920 | Holmes | 493/304 |
| 1,436,748 | 11/1922 | Yancey . | |
| 1,552,395 | 9/1925 | Deibel et al. | 29/623.2 |
| 1,575,894 | 3/1926 | Ayer | 493/31 |
| 1,593,021 | 7/1926 | Deibel et al. | 29/623.2 |
| 1,678,330 | 7/1928 | Clyne | 493/158 X |
| 2,215,789 | 9/1940 | Harrison | 493/158 |
| 2,579,907 | 12/1951 | Condon . | |
| 2,697,387 | 12/1954 | Falconer | 493/297 |
| 2,864,286 | 12/1958 | Rawson et al. | 493/108 X |
| 2,908,387 | 10/1959 | Walsh | 493/102 X |
| 2,973,698 | 3/1961 | Orlando . | |
| 3,105,421 | 10/1963 | Petri | 493/303 |
| 3,237,536 | 3/1966 | Ristvedt et al. | 493/303 |
| 3,252,388 | 5/1966 | Schur | 493/303 X |
| 3,374,298 | 3/1968 | Studen | 264/41 |
| 3,518,923 | 7/1970 | Buchholz et al. | 493/287 X |
| 3,777,631 | 12/1973 | Trask | 493/304 X |
| 3,795,964 | 3/1974 | Beckman | 493/304 |
| 3,802,050 | 4/1974 | Verhoest | 29/511 X |
| 4,156,710 | 5/1979 | Carroll et al. | 264/322 |
| 4,201,328 | 5/1980 | MacEwen | 493/108 X |
| 4,310,369 | 1/1982 | Miller et al. | 493/304 X |
| 4,317,323 | 3/1982 | Richards et al. | 493/108 X |

FOREIGN PATENT DOCUMENTS

| | | |
|---|---|---|
| 0031917 | 7/1981 | European Pat. Off. . |
| 150624 | 12/1902 | Fed. Rep. of Germany . |
| 568834 | 1/1933 | Fed. Rep. of Germany . |
| 1516169 | 1/1968 | France . |
| 2346138 | 10/1977 | France . |
| 585617 | 3/1977 | Switzerland . |
| 1556154 | 11/1979 | United Kingdom . |

*Primary Examiner*—James F. Coan

*Attorney, Agent, or Firm*—Peter K. Kontler

[57] ABSTRACT

Discrete sheets of separator material for use in dry cells are introduced tangentially into an annular clearance between the cylindrical internal surface of an outer tool and the cylindrical peripheral surface of an inner tool, and the inner tool is rotated about its axis while one or more spring-biased rollers urge the sheet in the clearance against its peripheral surface so that the sheet is converted into an inner tube which tends to expand radially and is introduced into an outer tube in response to axial shifting of the inner tool. A shoulder between the inner tool and a support for the inner tool pushes one end face of the inner tube from the clearance, and the inner tube is free to expand radially into contact with the internal surface of the respective outer tube in response to complete expulsion from the outer tool. The inner tool is then rotated in a direction to expand the inner tube prior to extraction of the inner tool from the outer tube, and the inner tube is held against extraction from the outer tube with the inner tool by the adjacent end face of the outer tool.

39 Claims, 9 Drawing Figures

METHOD AND APPARATUS FOR MAKING AND MANIPULATING INNER TUBES FOR USE IN DRY CELLS OR THE LIKE

BACKGROUND OF THE INVENTION

The present invention relates to a method of and to an apparatus for inserting radially expandible inner tubes into outer tubes. More particularly, the invention relates to improvements in a method and apparatus for inserting radially expandible inner tubes which consist of convoluted or otherwise deformed sheet-like material into normally rigid or substantially rigid outer tubes. Typical examples of inner tubes which can be formed and manipulated in accordance with the method and in the apparatus of the present invention are rolled or otherwise shaped sheets of synthetic plastic separator material which are confined in tubular bodies consisting of carbon or the like and are disposed in the interior of metallic housings or shells (also called cans) of cylindrical alkaline batteries, especially so-called dry cells.

A problem which arises in connection with the mass-production of rod-shaped dry cells is that of predictably inserting inner tubes of synthetic plastic separator material into outer tubes in such a way that the inner tubes are free, or are compelled, to expand into intimate contact with the internal surfaces of the respective outer tubes. The insertion of each inner tube must be completed within a small fraction of one second, and each inner tube should contact the internal surface of the respective outer tube even if the inner diameter of the outer tube (e.g., a hollow cylinder made of carbon) deviates from a standard value. Moreover, the smoothness of the internal surfaces of outer tubes often fluctuates within a wide range and the inner tubes are likely to be formed with internal protuberances which interfere with predictable insertion of inner tubes.

Certain presently known proposals to make inner tubes include placing two strips of deformable sheet material across each other to form a cruciform blank and thereupon forcing the central portion of the blank (namely the portion where the two strips overlap each other) into a cylindrical socket so that the blank is converted into an inner tube one end of which is closed and which is ready for insertion into an outer tube. A drawback of such inner tubes is that their thickness is not constant, as considered in the circumferential direction, as well as that the making of cruciform blanks is a time-consuming operation.

Another prior proposal involves the making of inner tubes by rolling flexible sheets into cylinders and by thereupon upsetting one end portion of each cylinder to form an elongated basket one end of which is closed. The basket is then ready to be inserted into an outer tube. This proposal exhibits the drawback that the basket cannot expand along its full length and also that the making of baskets takes up relatively long intervals of time.

A further prior proposal includes the utilization of adhesive to bond the layers of rolled sheets to each other. The adhesive prevents expansion of inner tubes into extensive contact with the outer tubes.

It was also proposed to use cylindrical inner tubes of rolled sheet material and to insert into each inner tube a separately produced cup which is adhesively secured to one end portion of the inner tube. The outermost convolution of each inner tube is bonded to the adjacent convolution. The cost of such inner tubes is very high, primarily due to lack of adequate apparatus for converting sheets of separator material into inner tubes.

Reference may also be had to commonly owned British Pat. No. 1,556,154 to Schubert et al.

OBJECTS AND SUMMARY OF THE INVENTION

An object of the invention is to provide a novel and improved method of forming inner tubes from separator material or the like and of inserting such inner tubes into outer tubes, especially into hollow cylindrical bodies consisting of or containing carbon and being located in the interior of metallic housings or shells for use in dry cells or the like.

Another object of the invention is to provide a method which renders it possible to ensure predictable expansion of radially expandible inner tubes into adequate contact with the internal surfaces of outer tubes.

A further object of the invention is to provide a method which can be practiced to make and insert large numbers of inner tubes per unit of time and which can be used to make inner tubes of the type wherein a sheet-like material forms one, two or more convolutions.

An additional object of the invention is to provide a method which can be practiced for the making of cylindrical or rod-shaped alkaline batteries in a time- and material-saving operation.

Still another object of the invention is to provide a combination of inner and outer tubes which are assembled in accordance with the above outlined method.

A further object of the invention is to provide an apparatus for making inner tubes and for inserting such inner tubes into outer tubes, especially in a machine for the making of rod-shaped dry cells.

Another object of the invention is to provide the apparatus with novel and improved means for converting discrete sheets of deformable separator material or the like into a succession of inner tubes or baskets in a time-saving operation and in such a way that each and every inner tube is capable of radial expansion to a desired extent.

An additional object of the invention is to provide the apparatus with novel and improved means for introducing inner tubes into discrete outer tubes.

A further object of the invention is to provide the apparatus with novel and improved means for deforming selected portions of inner tubes prior to and/or during introduction into outer tubes.

Another object of the invention is to provide an apparatus which can make and process several hundred inner tubes per minute and which can properly insert such inner tubes into outer tubes even if the inner diameters of outer tubes deviate from an optimum value.

An additional object of the invention is to provide the apparatus with novel and improved means for making and manipulating cups of separator material or the like for introduction into inner tubes subsequent to or simultaneously with insertion of inner tubes into outer tubes.

A further object of the invention is to provide a machine for making dry cells which embodies the above outlined apparatus.

One feature of the present invention resides in the provision of a method of introducing inner tubes into outer tubes having inner diameters which can fluctuate within a predetermined range (i.e., the inner diameters can vary from outer tube to outer tube). The method comprises the steps of converting a series of discrete sheets of flexible material (which tends to expand radially when rolled or otherwise converted into a tube) into inner tubes including feeding successive sheets of the series into an annular clearance which is disposed between the preferably cylindrical internal surface of an outer tool and the preferably serrated or otherwise roughened peripheral surface of an inner tool and whose maximum diameter preferably at most equals the minimum diameter of the aforementioned range and rotating one of the tools about the axis of the clearance to thereby wind the sheet around the inner tool, advancing each of the thus obtained inner tubes axially into a discrete outer tube including preferably restraining or inhibiting full radial expansion of the inner tubes, at least during a portion of the advancing step, and terminating the restraining step upon completion of the advancing step so that the inner tubes are free to expand radially into contact with the internal surfaces of the respective outer tubes regardless of eventual deviations of the inner diameters of outer tubes from an optimum diameter.

The rotating step can include rotating the inner tool relative to the outer tool.

The method can further comprise the step of subdividing a preferably continuous web of flexible material into the aforementioned series of discrete sheets including severing the web at such intervals that the length of each sheet suffices to convert it into an inner tube extending along an arc of more than 360 degrees as considered in the circumferential direction of the inner tool (i.e., each inner tube can have one full convolution plus a fraction of one additional convolution, one full additional convolution or more than one full additional convolution).

The method can further comprise the step of crimping or similarly deforming one end portion of each inner tube in the course of or prior to the advancing step. The crimping step can include converting the one end portion of each inner tube into a radially inwardly extending collar.

The method can also comprise the step of expanding or flaring one axial end of each inner tube not later than upon insertion into the respective outer tube, and such expanding step preferably includes heating the one end of each inner tube. The one end is preferably the trailing end, as considered in the direction of axial movement of inner tubes into the respective outer tubes.

The advancing step can include moving the inner tool axially of the clearance and into the outer tube.

Still further, the method can comprise the step of biasing the sheets against the one tool in the course of the rotating step. Such biasing step can include applying against the sheet in the annular clearance forces acting in a direction toward the one tool at a single location or at a plurality of locations which are spaced apart from each other as considered in the axial direction of the clearance.

The method can also comprise the step of moving the tools along a first path in the course of the rotating step and moving the outer tubes along a second path in the course of the advancing step. At least one of the paths can be an endless (e.g., circular) path.

The method can also comprise the step of inserting into each inner tube a preferably short (shallow) cup of the aforementioned material upon completion of the advancing step so that the cup is received in the innermost portion of the inserted inner tube. The material of the sheets is or can be a synthetic plastic material, e.g., the so-called separator material which is used in dry cells. The outer tubes can consist of or they can contain carbon.

The annular clearance is or can be at least substantially vertical.

In accordance with a presently preferred embodiment of the method, the advancing step includes moving the inner tool and the inner tube into the respective outer tube, and such method preferably further comprises the steps of rotating the inner tool relative to the inserted inner tube in a direction to promote radial expansion of the inner tube and separation of the expanded inner tube from the inner tool, and thereupon extracting the inner tool from the inner tube.

If a restraining step is necessary, it can include maintaining a portion of each inner tube in the interior of the outer tool in the course of the advancing step. If the advancing step includes moving the inner tool and the inner tube axially relative to the outer tool and into the respective outer tube until the inner tube leaves the clearance and is free to expand radially, the method preferably further comprises the step of extracting the inner tool from the inner tube at a time while the outer tool prevents reentry of the radially expanded inner tube into the annular clearance.

Another feature of the invention resides in the provision of an apparatus for introducing inner tubes into outer tubes having inner diameters which can fluctuate within a predetermined range. The apparatus comprises an outer tool having a substantially cylindrical passage with a diameter which preferably at most equals the smallest diameter of the aforementioned range, an inner tool which is receivable in the passage to define with the outer tool an annular clearance, an inlet provided in the outer tool and preferably extending substantially longitudinally (tangentially or radially) of and communicating with the clearance, a source of supply of discrete sheets consisting of a flexible material (e.g., a synthetic plastic substance which can constitute the separator material in a dry cell) which normally tends to expand radially when the sheet is rolled or otherwise converted into a tube, means for feeding successive sheets from the source into the clearance by way of the inlet, means for rotating one of the tools relative to the other tool (preferably for rotating the inner tool relative to the outer tool) about the axis of the clearance so that successive sheets which enter the clearance are convoluted around the inner tool and are thus converted into a succession of inner tubes, means for advancing successively formed inner tubes into discrete outer means and preferably also means for restraining or inhibiting complete radial expansion of inner tubes during advancement into the respective outer tubes so that each portion of an inner tube is preferably free to expand radially into contact with the internal surface of the respective outer tube only upon completed insertion into the corresponding outer tube.

If a restraining means is used, it can form part of the outer tool and the peripheral surface of the inner tool is preferably serrated and/or otherwise roughened to facilitate the winding of sheets onto the inner tool.

The apparatus preferably further comprises means for biasing the sheets in the clearance against the one (rotating) tool to thus ensure that such tool entrains the sheets into the clearance and rolls them around the inner tool.

The source of supply can include means for subdividing an elongated web of the aforediscussed material into sheets each of which has a length sufficing to ensure its conversion into an inner tube extending along an arc of more than 360 degrees as considered in the circumferential direction of the inner tool. For example, each inner tube can comprise two, three, four or even more complete convolutions.

The advancing means can include means for moving the inner tool in the axial direction of the annular clearance. The axis of the clearance is or can be substantially vertical and the apparatus can further comprise first conveyor means (e.g., a first rotary drum) for moving the tools along a first path and second conveyor means (e.g., a second rotary drum) for moving the outer tubes along a second path. At least one of these paths is or can be an endless (e.g., circular) path, and the two paths intersect or touch each other in the region where successive inner tubes are introduced into the respective outer tubes.

The apparatus can further comprise means for crimping one end portion of each inner tube prior to advancement of the inner tube into the respective outer tube. Such crimping means can include a suitable die or other means for converting the one end portion of each inner tube into a radially inwardly extending annular collar.

The apparatus can further comprise means for radially expanding or flaring one end portion of each inner tube not later than upon completed introduction into the respective outer tube. Such expanding or flaring means can comprise a heated mandrel which is reciprocable into and from the one end portion of each inner tube, preferably after the inner tube is fully inserted into the respective outer tube.

In accordance with a presently preferred embodiment of the apparatus, the advancing means can comprise a support for the inner tool (such support can include a rod-shaped body which can fit snugly into the passage of the outer tool). The support and the inner tool define a preferably annular shoulder which is adjacent to one axial end of the inner tube in the annular clearance, and such advancing means further comprises means for reciprocating the support axially of the inner tool so that the shoulder advances inner tubes from the annular clearance into the respective outer tubes while the support is moved in a direction to introduce the inner tool and the inner tube thereon into a registering outer tube. The just outlined apparatus preferably further comprises means for rotating the inner tool in a direction to unwind the inner tube which surrounds the peripheral surface while the inner tool is located in the interior of an outer tube.

If a restraining means is used, it can include the internal surface of the outer tool (i.e., the surface which surrounds the aforementioned passage).

The aforementioned biasing means can include spring-biased means for pressing the sheets in the annular clearance against the one tool to thus ensure that each sheet is predictably wound around the peripheral surface of the inner tool. As mentioned above, the one (rotated) tool is preferably the inner tool, and the pressing means can comprise a pressing member which extends into a window which is provided in the outer tool (such window communicates with the clearance) and means (e.g., a spring-biased lever) for urging the pressing member against the sheet in the clearance so that the sheet is held against slippage with reference to the rotating inner tool.

The apparatus can further comprise means for forming cups of the material which is used for the sheets, and means for inserting discrete cups into successive inner tubes upon advancement of inner tubes into the respective outer tubes.

The outer tool includes a portion which is adjacent to successive outer tubes during advancement of inner tubes into the respective outer tubes, and such portion of the outer tool is located in the path of movement of the outer end portion of a freshly inserted inner tube in a direction to leave the respective outer tube so that the outer tool prevents extraction of inner tubes from the respective outer tubes.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
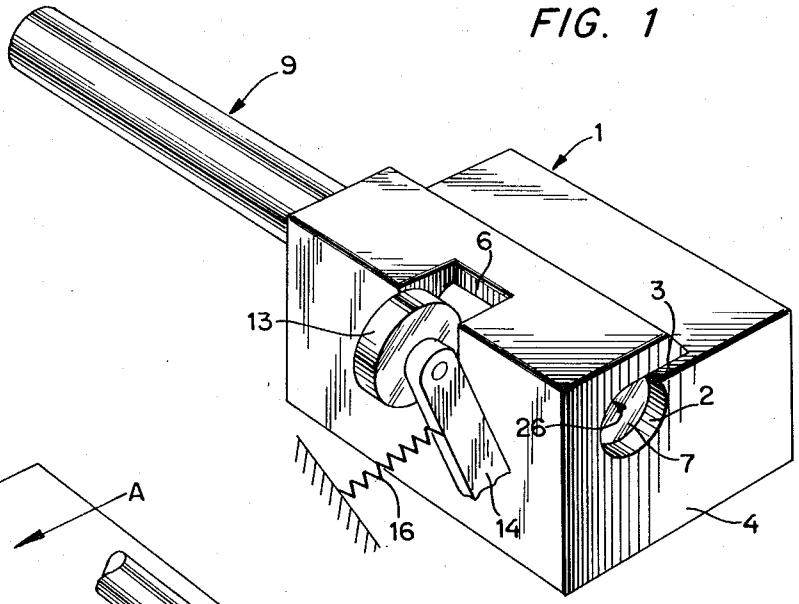
FIG. 1 is a schematic perspective view of a rudimentary apparatus for the making and processing of inner tubes in accordance with the invention.

Referring first to FIGS. 1 to 5, there is shown an apparatus which comprises a single outer tool 1 and a single inner tool 7. The outer tool 1 is a block-shaped body having a cylindrical passage 2 bounded by a cylindrical internal surface 26, a window 6 which communicates with an intermediate portion of the passage 2, and an elongated slit-shaped inlet 3 which extends longitudinally and tangentially of the passage 2 and communicates with the latter substantially diametrically opposite the window 6.

The inner tool 7 is an elongated rod-shaped member whose cylindrical peripheral surface 8 is knurled, serrated and/or otherwise roughened and whose diameter is somewhat less than the inner diameter of the passage 2 so that, when the tool 7 is inserted into the outer tool 1, the surfaces 8 and 26 define an annular clearance or gap 12 wherein successive sheets 17 of flexible material (e.g., a synthetic plastic substance which is used as a separator material in dry cells) are converted into a series of cylindrical bodies 18 (hereinafter called inner tubes). Successive sheets 17 are fed into the inlet 3 by a pair of advancing rolls 24 at least one of which is driven to move the sheet 17 in the nip between such rolls in the direction which is indicated by the arrow A.

One end portion of the inner tool 7 is separably secured to or is made integral with an elongated rod-shaped support or ram 9 whose diameter matches or is only very slightly less than the diameter of the cylindrical internal surface 26 of the outer tool 1. The neighboring end portions of the inner tool 7 and support 9 define an annular shoulder 11 which, together with the support 9 and a rack-and-pinion drive 34, constitutes a means for advancing successively formed inner tubes 18 into discrete outer tubes 22, e.g., into outer tubes consisting of or containing carbon and being installed in the interior of discrete cylindrical shells 21 each of which has an open end and a closed end. The shells 21 consist of a metallic material and the outer tubes 22 can be said to constitute the internal liners of such shells. The apparatus further comprises a reversible electric motor 19 or other suitable means for rotating the support 9 and the inner tool 7 in a clockwise or in a counterclockwise direction.

Figure 2:
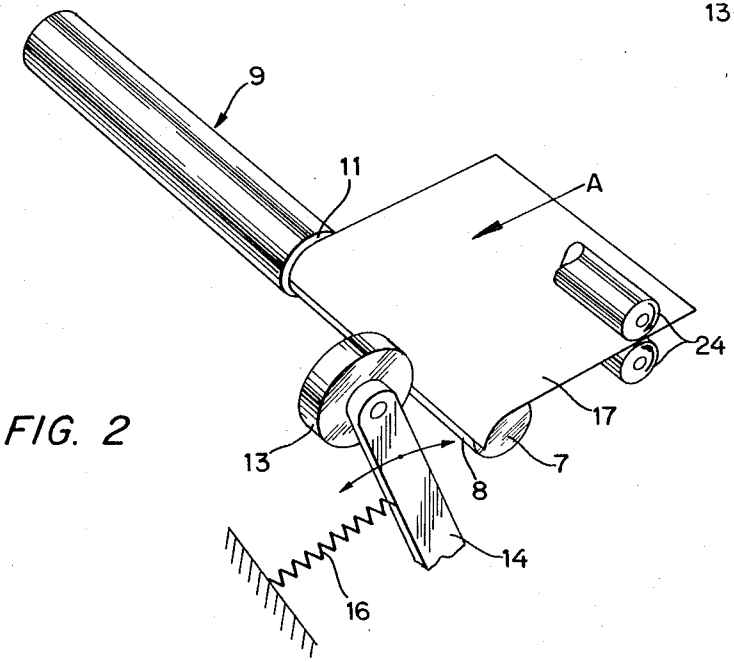
FIG. 2 is a similar view of the rudimentary apparatus, with the outer tool omitted in order to show the manner of converting a sheet into an inner tube.
Figure 3:
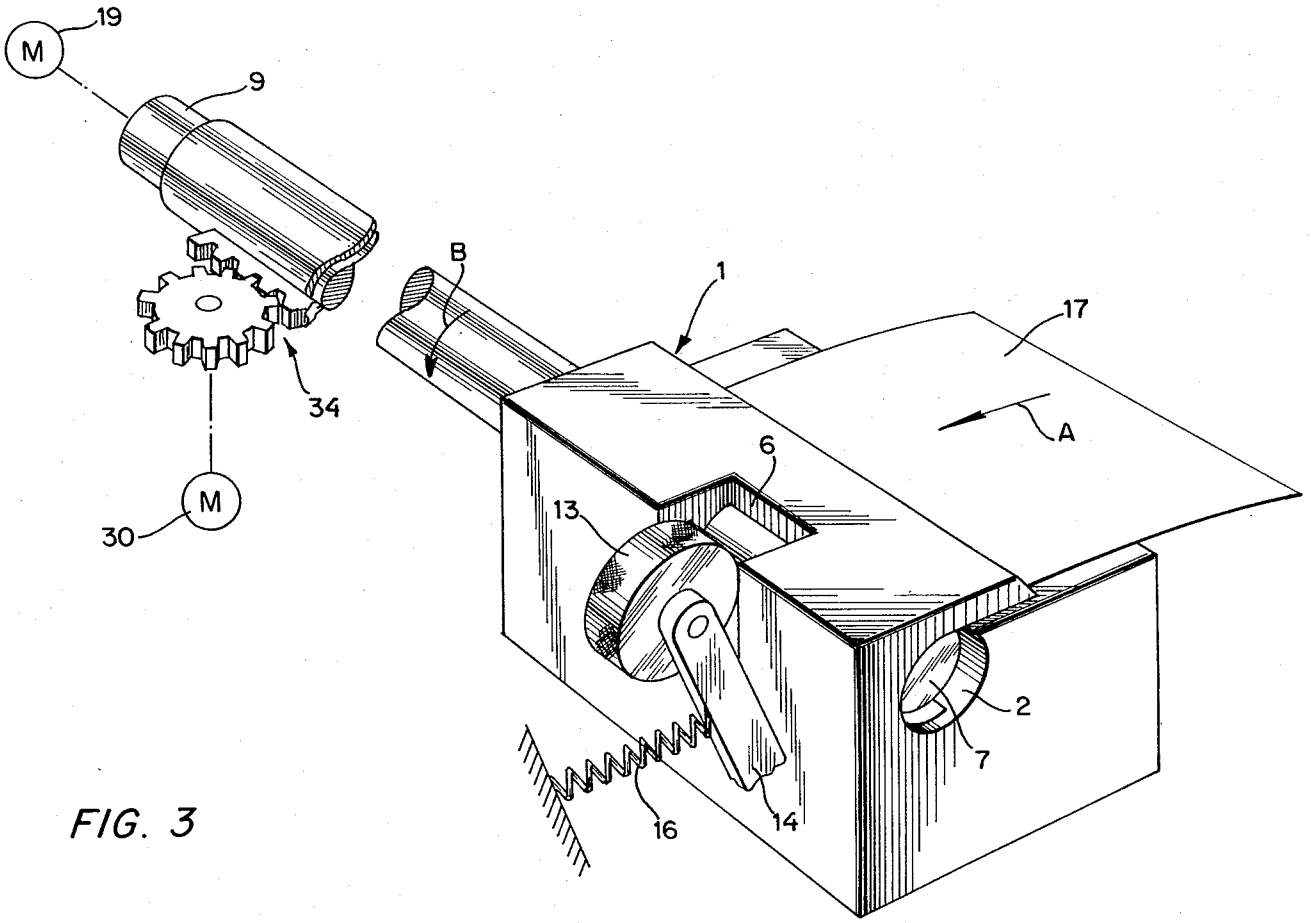
FIG. 3 shows the apparatus of FIG. 1 during the initial stage of introduction of a sheet into the annular clearance between the inner and outer tools.

The means for biasing a sheet 17 in the annular clearance 12 against the peripheral surface 8 of the inner tool 7 (which is then driven by the motor 19 in a counterclockwise direction as indicated by the arrow B) comprises an idler roller 13 or an analogous pressing member, a pivotable lever 14 one end of which has a pin for the idler roller 13, and a coil spring 16 or other suitable means for biasing the lever 14 in a clockwise direction, as viewed in FIGS. 1, 2 or 3. A disc cam 15 or other suitable means is provided for intermittently lifting the idler roller 13 out of the window 6 so as to allow for unimpeded advancement of a freshly formed inner tube 18 in the axial direction of the clearance 12 and inner tool 7.

That portion of the stationary outer tool 1 which is provided with an end face 4 constitutes a means for preventing extraction of inner tubes 18 from the respective outer tubes 22. To this end, the outer tubes 22 are moved stepwise or continuously into register with successively formed inner tubes 18 (i.e., with the clearance 12) by a preferably drum-shaped conveyor (see the conveyor 31 in FIG. 7) and the open ends of the respective cylindrical shells 21 are closely or immediately adjacent to the end face 4 so that an inner tube 18 which has entered the respective outer tube 22 and was caused and/or allowed to radially expand therein abuts against the end face 4 and is thus prevented from reentering the clearance 12 if such inner tube exhibits the tendency to leave the interior of the corresponding outer tube 22. As a rule, or in many instances, the inner diameters of the outer tubes 22 (in the cylindrical shells 21 which are to be converted into housings of dry cells) fluctuate within a certain range and the diameter of the internal surface 26 in the outer tool 1 is preferably less than or at most equals the smallest diameter of such range. This ensures that an inner tube 18 which is formed in the annular clearance 12 will invariably enter the outer tube 22 in the aligned shell 21 as long as the leading end of the inner tube 18 which is in the process of leaving the clearance 12 is not permitted to expand radially before the leading end enters the adjacent end portion of the registering outer tube 22.

The rack-and-pinion drive 34 maintains the support 9 and the inner tool 7 in the axial positions of FIGS. 1–3, and the coil spring 16 is free to urge the idler roller 13 into the window 6 when the advancing rolls 24 are caused to feed a fresh sheet 17 into the inlet 3 of the outer tool 1 (arrow A) so that the leading edge of such sheet enters the clearance 12 and is engaged by the peripheral surface 8 of the inner tool 7 which is then driven by the motor 19 to rotate in the direction of arrow B. The inner tool 7 cooperates with the preferably knurled, serrated or otherwise roughened peripheral surface of the idler roller 13 and with the internal surface 26 of the outer tool 1 to convert the sheet 17 into an inner tube 18 whose outer diameter matches the diameter of the internal surface 26 and whose inner diameter matches the diameter of the peripheral surface 8. The length of the sheet 17 is such that it forms at least one convolution as a result of conversion into an inner tube 18. In many or even in most instances, a sheet 17 which is to be converted into a portion of the separator basket in a dry cell will be transformed into an inner tube which extends along an arc of more than 360 degrees (e.g., 540, 720, 1080 or more degrees) as considered in the circumferential direction of the inner tool 7. This is desirable and advantageous if the density of the material of the sheets 17 is not uniform because the density of a multiple-convolution or multiple-wrap inner tube 18 us much more likely to be uniform than the density of an inner tube which consists of a single layer or convolution of such material.

The axial length of the inner tool 7 is preferably somewhat less than the width of the sheet 17 which is admitted into the clearance 12 via inlet 3. This renders it possible to crimp or to otherwise deform the right-hand end portion of a freshly formed inner tube 18 into a radially inwardly extending collar 35, e.g., by means of a die 32 of the type shown in FIG. 6. The purpose of collars 35 is to allow for predictable positioning of cups 37 (shown in FIG. 6) which are preferably made simultaneously with inner tubes 18 and are inserted into the deepmost portions of inner tubes after the inner tubes have been properly inserted into the respective outer tubes 22. The assembly of an inner tube 18 with a cup 37 results in the formation of a separator basket which includes a cylindrical section (former sheet 17) and an end wall (the bottom wall of the corresponding cup 37). The conversion of one end portion of each inner tube 18 into a collar 35 preferably takes place while the inner tube is on the way toward a position of axial alignment with the corresponding outer tube 22.

When the conversion of a sheet 17 into an inner tube 18 is completed, the reversible motor 30 which rotates the pinion of the rack-and-pinion drive 34 is caused to move the support 9 axially in the direction which is indicated by the arrow C whereby the shoulder 11 bears against the adjacent end face of the inner tube 18 and expels it from the clearance 12. The axial length of such clearance 12 decreases in response to axial movement of the support 9 in the direction of the arrow C because the support penetrates into the passage 2 and fills the latter in a direction from the left-hand end toward the right-hand end of the passage. At such time, the open end of a cylindrical shell 21 with an outer tube 22 therein is in accurate register with the clearance 12 so that the leader of the inner tube 18 enters the adjacent end of the outer tube after negligible or no radial expansion at all. The motor 19 preferably continues to rotate the support 9 in the direction of the arrow B while the support moves axially in order to expel the freshly formed inner tube 18 from the outer tool 1 and to introduce the inner tool 7 into the interior of the aligned outer tube 22 and shell 21. The cylindrical internal surface 26 of the outer tool 1 prevents premature radial expansion of the inner tube 18 on its way toward and into the aligned outer tube 22; this ensures that the leader of the inner tube invariably finds its way into the adjacent end portion of the outer tube even if the inner diameter of the outer tube is the smallest diameter within the aforediscussed predetermined range of diameters. The material of the inner tubes 18 normally exhibits a pronounced tendency to effect radial expansion of such inner tubes; therefore, the leader of the inner tube which is being pushed by the shoulder 11 into the aligned outer tube 22 is likely to undergo radial expansion and to rub against the internal surface of the outer tube. At any rate, the internal surface 26 of the stationary outer tool 1 prevents complete radial expansion of the inner tube 18 during axial advancement of such inner tube into the interior of the outer tube. However, the entire inner tube is free to expand radially and to come into desirable pronounced contact with the internal surface of the respective outer tube as soon as the introduction of the inner tube into the outer tube is completed. The collar 35 at the leading end of the inner tube 18 inhibits radial expansion of such leading end, especially if the inner tube consists of several convolutions.

Figure 4:
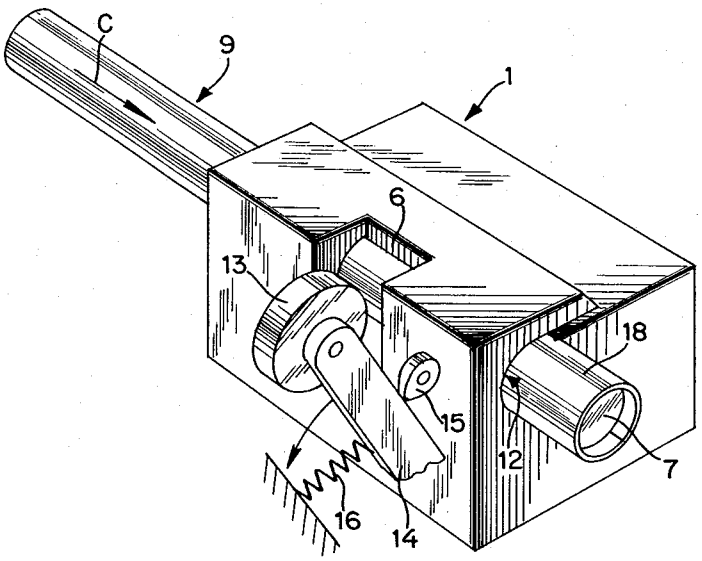
FIG. 4 shows the structure of FIG. 3 during the initial stage of expulsion of a freshly formed inner tube from the annular clearance.
Figure 5:
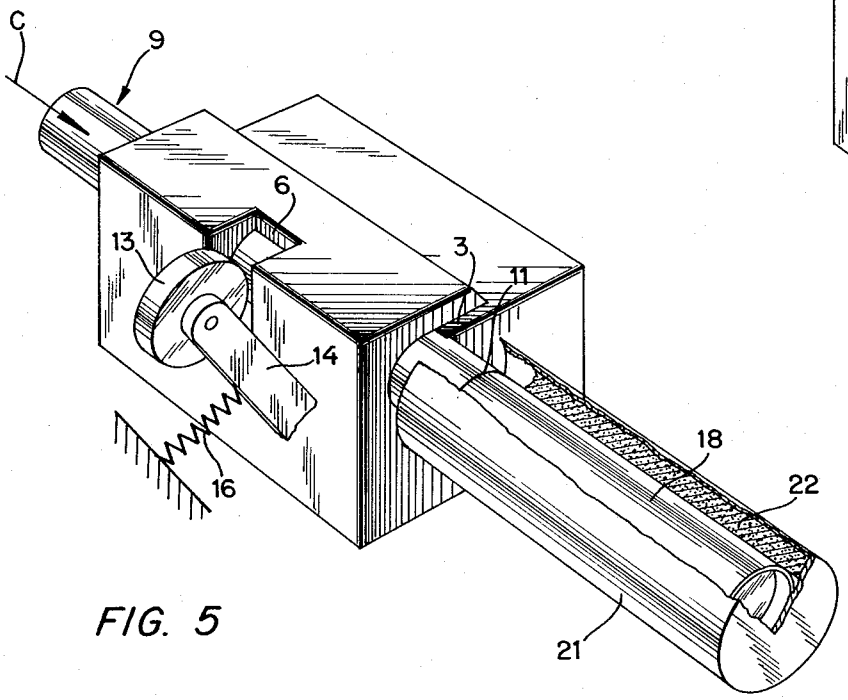
FIG. 5 shows the structure of FIG. 4 during the last stage of advancement of an inner tube into the registering outer tube.

The cam 15 is preferably set in rotary motion to lift the idler roller 13 out of the window 6 in response to starting of the motor 30 in a direction to move the support 9 axially into the passage 2 of the stationary outer tool 1. This reduces the likelihood of deformation of the freshly formed inner tube 18 on its way from the clearance 12 into the corresponding outer tube 22. The retracted position of the roller follower 13 is shown in FIGS. 4 and 5.

The motor 19 is caused to rotate the support 9 and the inner tool 7 counter to the direction which is indicated by arrow B as soon as the advancement of a freshly formed inner tube 18 into the corresponding outer tube 22 is completed. This entails radial expansion of the inner tube 18 into adequate or pronounced contact with the internal surface of the outer tube 22 and allows for ready extraction of the tool 7 from the interior of the thus expanded inner tube 18. Any tendency of the expanded inner tube 18 to share the next-following axial movement of the inner tool 7 counter to the direction which is indicated by the arrow C is counteracted by the end face 4 of the outer tool 1. In other words, if the friction between the inner tube 18 and the roughened peripheral surface 8 of the inner tool 7 is greater than the friction between the external surface of the inner tube and the internal surface of the outer tube (while the rack-and-pinion drive 34 is in the process of extracting the tool 7 from the registering shell 21), the extent of axial movement of the inner tube out of the outer tube is limited by the adjacent portion of the stationary outer tool 1.

The cam 15 is rotated again in order to allow for reentry of the idler roller 13 into the window 6 under the action of the coil spring 15 not later than when the leader of a freshly introduced sheet 17 reaches the window 6 so that such sheet cannot slip with reference to the rotating inner tool 7 when the latter is in the process of forming a fresh inner tube 18.

It is also within the purview of the invention to rotate the outer tool 1 relative to the inner tool 7 or to rotate the tools 1 and 7 in opposite directions about the axis of the clearance 12 in order to convert successive sheets 17 into a series of inner tubes 18. However, the provision of means for rotating the inner tool 7 relative to the outer tool 1 is preferred at this time because the mass of the inner tool is relatively small, i.e., the inner tool can be more rapidly accelerated and/or decelerated, started to move axially or arrested upon completion of axial movement into or from an aligned shell 21.

The motor 19 can be replaced with an elongated pinion on the support 9 and a gear which is in constant mesh with such pinion irrespective of the axial position of the inner tool 7 and which is driven by a reversible electric, pneumatic, hydraulic or other motor.

Figure 6:
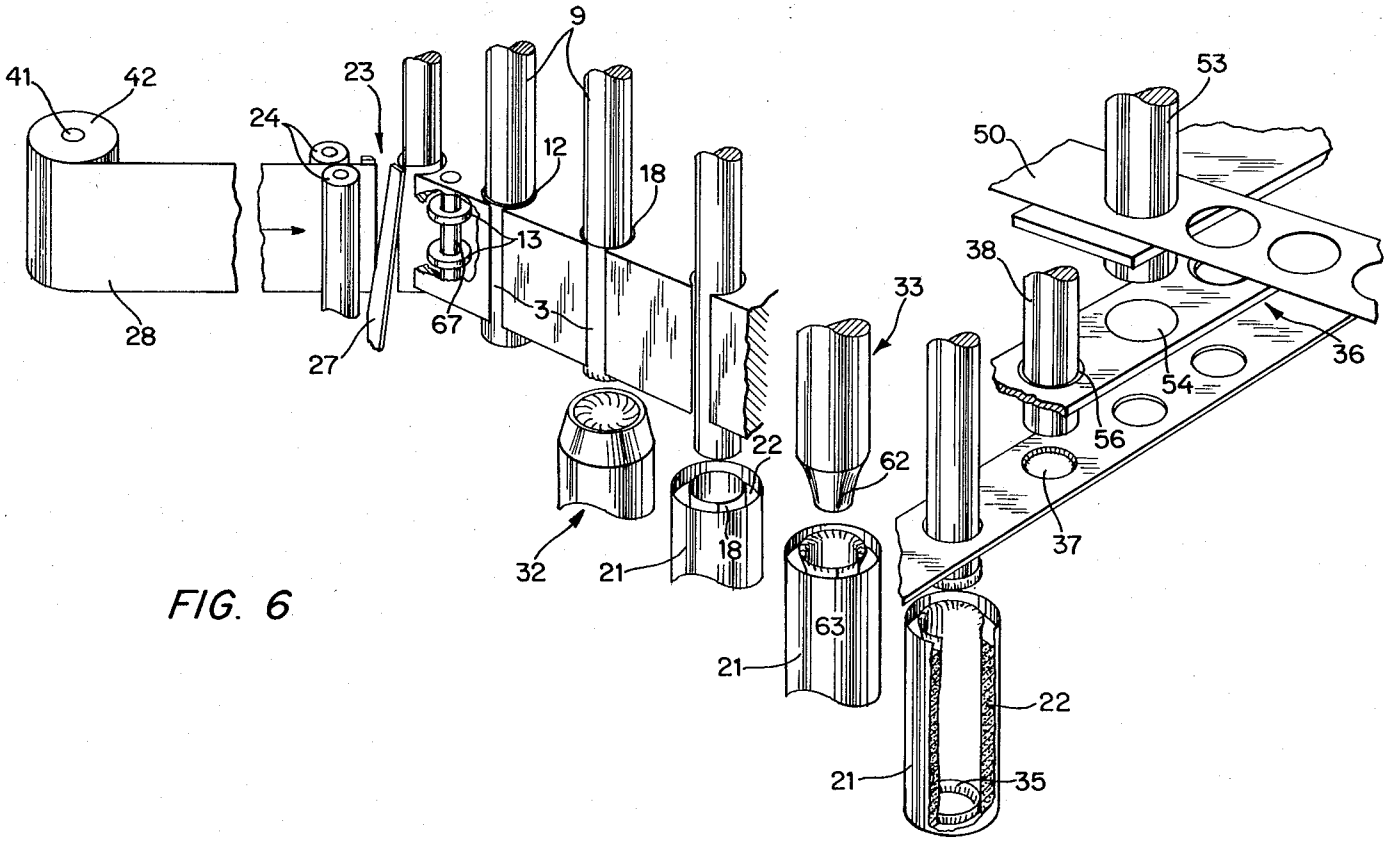
FIG. 6 is a developed perspective view of a modified intermittently operated apparatus with a battery of cooperating inner and outer tools.
Figure 7:
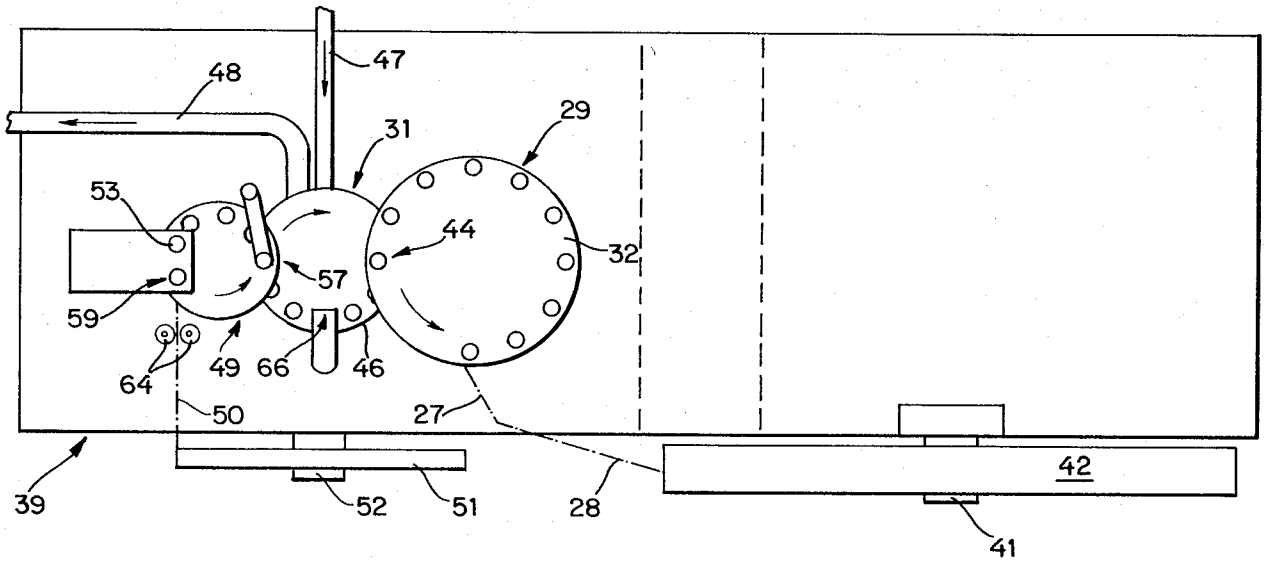
FIG. 7 is an enlarged plan view of the intermittently operated apparatus.
Figure 8:
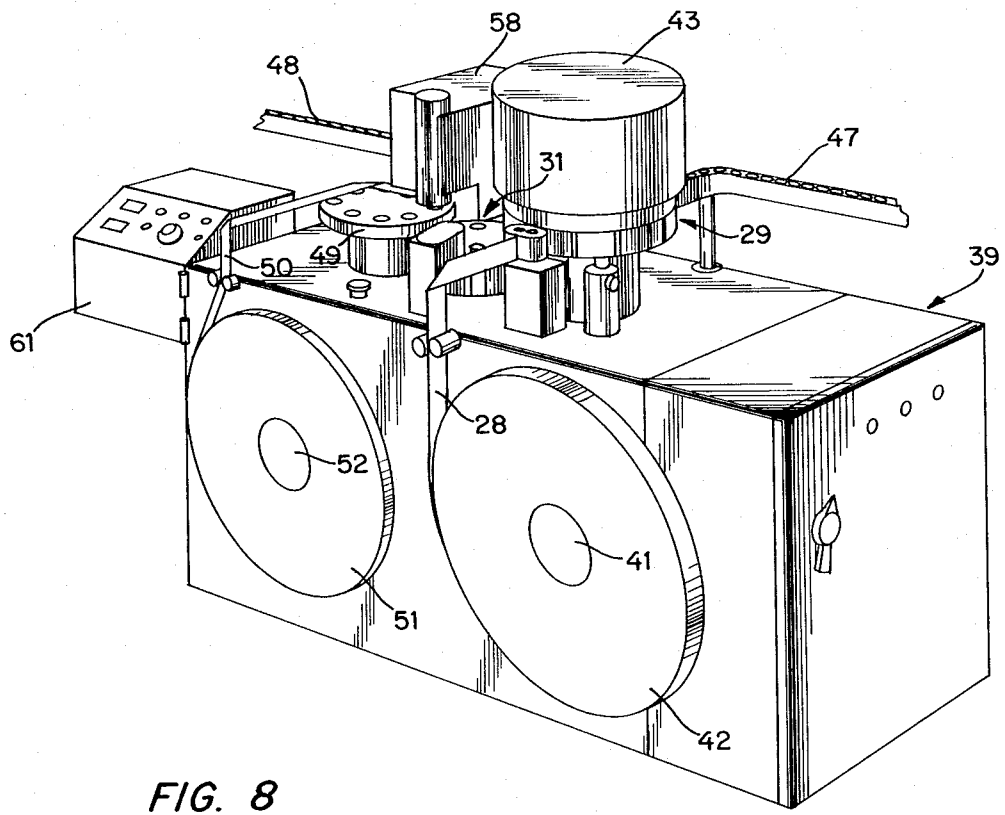
FIG. 8 is a smaller-scale perspective view of the apparatus of FIGS. 6 and 7.

FIGS. 7 and 8 illustrate certain details of a modified apparatus which employs an annulus of inner tools 7 and an equal number of outer tools 1. The outer tools 1 form part of or are attached to a rotary drum-shaped conveyor 29 which is mounted on top of a housing or frame 39. The front side of the housing 39 carries a spindle 41 for a reel 42 of convoluted web 28 which is severed at predetermined intervals by a severing device 27 (FIG. 6) so as to form a series of discrete sheets 17 which are fed by the advancing rolls 24 to enter the inlets 3 of oncoming outer tools 1 on the conveyor 29. The cover 43 of the apparatus which is shown in FIG. 8 conceals the means for rotating the supports 9 for the inner tools 7 and the means for moving the supports 9 axially up and down (the axes of the annular clearances 12 which are defined by the pairs of tools 1 and 7 in the apparatus of FIGS. 6 to 8 are vertical or substantially vertical). The means for moving successive supports 9 up and down can comprise roller followers on the supports and a stationary cam having a suitably configurated endless cam groove which causes each support to move up or down during a certain stage of angular movement of the conveyor 29 about its vertical axis. The means for indexing the conveyor 29 includes a suitable prime mover and a transmission (e.g., a geneva movement) in the interior of the housing 39.

The conveyor 31 for shells 21 and outer tubes 22 is or includes a drum which is indexible adjacent to the upper side of the housing 39 and whose intermittent angular movements about a vertical axis are synchronized with those of the conveyor 29. A portion of the conveyor 29 overlies a portion of the conveyor 31 at a station 44. Successive sockets 46 of the conveyor 31 receive empty outer tubes 22 (i.e., successive shells 21) from a first channel 47 and successive filled outer tubes 22 are transferred from the corresponding sockets 46 into a second channel 48.

A portion of the conveyor 31 is further overlapped by a third rotary indexible conveyor 49 on which successive increments of a web 50 are converted into a succession of cups 37. The web 50 is stored on a reel 51 on a spindle 52 at the front side of the housing 39, and the means 36 for forming cups 37 further comprises a punch 53 which removes from the web 50 a succession of disc-shaped blanks 54 overlying holes 56 and moving into the range of a vertically reciprocable inserting device 38 at a station 57 where the conveyor 31 partially overlies the conveyor 49. The device 38 performs a downward stroke under the action of suitable reciprocating means (e.g., a fluid-operated motor or a reciprocable electromagnet in the casing 58 above the conveyor 49). Alternatively, the disc-shaped blanks 54 are converted into cups 37 at a station 59 which is adjacent to the punch 53 and the thus obtained cups 37 are then transported to the station 57 to be introduced into the adjacent inner tubes 18 (in the interior of the respective outer tubes 22) by the inserting device 38.

The speed of operation of the apparatus of FIGS. 6 to 8 can be regulated by an operator from a control panel 61. The apparatus can turn out several hundred assemblies of inner and outer tubes per minute.

The apparatus of FIGS. 6 to 8 preferably further comprises a reciprocable mandrel 33 having a suitably configurated (e.g., substantially frustoconical) lower end portion 62 which is heated by one or more cartridges (not specifically shown) and serves to expand or flare out the upper end portions 63 of successive inner tubes 18 subsequent to introduction of such inner tubes into the respective outer tubes 22 at the station 44 but prior to insertion of cups 37 at the station 57. An advantage of radially expanding the upper end portions 63 of inserted inner tubes 18 is that this ensures more predictable insertion of cups 37 by the device 38 (or by other suitable means) at the station 57.

The reel 42 and the severing device 27 can be said to constitute a source of supply of discrete sheets 17.

The mode of operation of the apparatus of FIGS. 6 to 8 is as follows:

The drum-shaped conveyors 29, 31 and 49 are indexed in synchronism so that an empty outer tube 22 is delivered to the station 44 when such station receives the foremost uninserted inner tube 18, and that a properly inserted inner tube 18 is located at the station 57 whenever such station receives the foremost uninserted cup 37. The inlets 3 of successive outer tools 1 receive discrete sheets 17 from the advancing rolls 24 during successive intervals of dwell of the conveyor 29, and such sheets are then converted into inner tubes 18 in a manner as described in connection with FIGS. 1–5 except that the supports 9 for the inner tools 7 are preferably reciprocated by pinions and a stationary cam mounted under the cover 43. On its way toward the station 44, each inner tool 7 is caused to perform a short downward stroke so as to cooperate with the crimping die 32 in converting the lower end portions of successive inner tubes 18 into radially inwardly extending annular collars 35.

The introduction of successive inner tubes 18 into the respective outer tubes 22 takes place at the station 44, and the mandrel 33 is then caused to descend in order to convert the upper end portion of each freshly inserted inner tube into an outwardly flaring flange or collar 63 as a result of the application of heat and pressure to the normally synthetic plastic separator material of the converted (convoluted) sheets 17.

The web 50 is fed stepwise by two advancing rolls 64 and yields a succession of blanks 54 at the station for the punch 53. The blanks 54 are converted into cups 37 by the inserting device 38 at the station 57 or by a specially designed member at the station 59. Successive cups 37 are introduced into the oncoming inner tubes 18 (in the respective outer tubes 22) at the station 57, and the shells 21 are then transferred from their sockets 46 into the channel 48 at the station 66.

FIG. 6 further shows that each outer tool 7 can be formed with two windows 6, one for each of two idler rollers 13 which are mounted on a common shaft 67 and can be biased by a common spring as well as retracted by a single cam, not shown. The two idler rollers 13 are spaced apart from one another, as considered in the axial direction of the inner tools 7. The provision of several idler rollers 13 for each outer tool 1 or of a single set of several idler rollers for all outer tools further reduces the likelihood of unpredictable conversion of sheets 16 into inner tubes 18. The shaft 67 can be installed on the housing 39 adjacent to that portion of the endless path which is defined by the conveyor 29 where successive inner tools 1 are rotated in order to convert sheets 17 into an inner tube 18. Such station can be closely adjacent to the advancing rolls 24.

Figure 9:
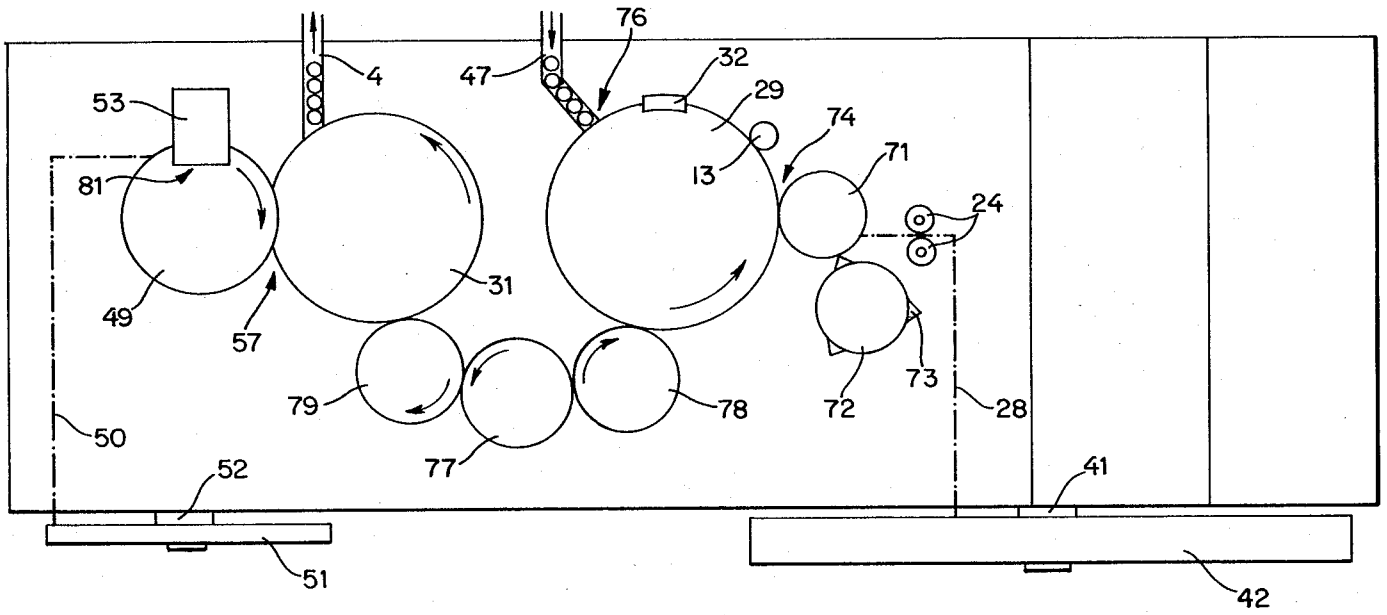
FIG. 9 is a plan view of a continuously operated apparatus.

FIG. 9 shows a modified apparatus wherein the outer tubes 22 and their shells 21 are in continuous motion during travel from the first channel 47 toward and into the second channel 48. The web 28 is fed by two advancing rolls 24 onto a rotary suction drum 71 of the class used in many filter tipping machines to subdivide a continuous web of tipping paper into discrete uniting bands for convolution around tobacco-containing rod-shaped sections and the adjacent filter mouthpieces in order to form filter cigarettes of unit length or multiple unit length. Machines of the type using such suction drums are known as MAX and MAX S and are manufactured and sold by the assignee of the present application. The drum 71 cooperates with a cutting drum 72 having a set of three equidistant knives 73 which subdivide the web 28 into discrete sheets 17, and such sheets are fed into the passages 2 of successive outer tools 7 on a drum 29 at a station 74. One or more spring-biased idler rollers 13 are provided downstream of the station 74 to cooperate with the oncoming inner tools 7 in order to convert the sheets 17 into inner tubes 18 whose lower end portions are crimped at 32 and which are inserted into the oncoming outer tubes 22 at the station 76. The thus obtained assemblies of shells 21, outer tubes 22 and inner tubes 18 are transferred onto a further rotary conveyor 77 by a first transfer conveyor 78, and the upper end portions of the inner tubes 18 (which are already confined in the corresponding outer tubes 22) are thereupon expanded or flared by a mandrel (not specifically shown) which moves back and forth in and counter to the direction of rotation of the conveyor 77. A second transfer conveyor 79 delivers successive shells 21 (with the respective inner and outer tubes therein) from the conveyor 77 onto a conveyor 31 whereon the shells 21 are transported past a station 57 for introduction of cups 37 which are formed on a conveyor 49. The punch 53 is located at the station 81, and the spindle 52 for the reel 51 is mounted at the front side of the housing 39. The prime movers and transmissions for the continuously and intermittently driven parts are mounted in the interior and/or on top of the housing 39.

At the present time, the improved apparatus is used for the making of alkaline dry cells, and more particularly for the making or insertion of so-called separator baskets each of which includes an inner tube 18 and a cup 37. As mentioned above, the apparatus can be designed to form double wrap, triple wrap, quadruple wrap, etc. inner tubes (i.e., each such tube can have two or more convolutions), and each inner tube can further contain extra material to form an additional overlap in order to ensure that the density of each and every portion of the finished inner tube will match or closely approximate a desired density. The apparatus can be readily converted for the making and insertion of inner tubes or separator baskets into shells of a wide variety of sizes (including those known as C, AA, AAA, AAAA and/or others), and the apparatus can turn out large numbers (e.g., between 150 and 300 but even up to 600) of inner tubes per minute. The overall dimensions of the improved apparatus are surprisingly small (e.g., the apparatus which are shown in FIGS. 8 and 9 can be 3 feed wide, 8 feet long and 7 feet high with a nominal working height of 36±1"). The drives for the various conveyors are preferably of the variable-speed type in order to allow for a relatively slow start and gradual increase to nominal operating speed. All service areas are readily accessible. The basic operating principles of the intermittent motion (FIGS. 6–8) and continuous motion apparatus (FIG. 9) are similar. The dimensions of successively formed sheets 17 are controlled by the advancing rolls 24.

Reaming of outer tubes 22 (to ensure that the inner diameter of each outer tube closely approximates an optimum inner diameter and that the outer tubes do not exhibit internal protuberances which could interfere with introduction of inner tubes) is desirable and advantageous but not absolutely necessary. The inner tube crimping and flaring means are also optional. The material of the sheets 17 and web 50 may be the same as that which is presently used for the making of separator baskets in accordance with heretofore known techniques.

Rotation of the inner tool 7 in a direction to unwind the inner tube 18 in the interior of the outer tube 22 for the purpose of facilitating extraction of the inner tool from the outer tube can be assisted or replaced by blasts of compressed air. Thus, each inner tool 7 can be connected to a source of compressed air and can be provided with suitable channels and/or ports which discharge streamlets of compressed air into the interior of inner tubes 18 as soon as the inner tubes are properly received in the respective outer tubes. For example, each inner tool 7 can have an axially extending channel whose rear end portion is connected to a source of compressed air as soon as the inner tool reaches a given axial position in which its surface 8 is located in an outer tube 22, and a plurality of radially extending bores or ports which communicate with the axially extending channel and extend to the peripheral surface 8 to discharge streamlets of air into that inner tube 18 which is received in an outer tube 22 and still surrounds the inner tool.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of introducing inner tubes into outer tubes, comprising the steps of converting a series of discrete sheets of flexible material into inner tubes including feeding successive sheets of the series into an annular clearance which is disposed between the internal surface of an outer tool and the peripheral surface of an inner tool, and rotating one of the tools about the axis of the clearance to wind the sheet around the inner tool; advancing each of the thus obtained inner tubes axially into a discrete outer tube, including moving the inner tool with the inner tube into the respective outer tube; rotating the inner tool relative to the inserted inner tube in a direction to promote radial expansion of the inner tube and separation of the thus expanded inner tube from the inner tool; and thereupon extracting the inner tool from the inner tube.

2. The method of claim 1, wherein said rotating step includes rotating the inner tool relative to the outer tool.

3. The method of claim 1, further comprising the step of subdividing a continuous web of flexible material into said series of discrete sheets including severing the web at such intervals that each of the thus obtained sheets is converted into an inner tube extending along more than 360 degrees in the circumferential direction of the inner tool.

4. The method of claim 1, further comprising the step of crimping one end portion of each inner tube in the course of or prior to said advancing step.

5. The method of claim 4, wherein said crimping step includes converting the one end portion of each inner tube into a radially inwardly extending collar.

6. The method of claim 1, further comprising the step of expanding one axial end of each inner tube not later than upon insertion into the respective outer tube.

7. The method of claim 6, wherein the one axial end is the trailing end, as considered in the direction of axial movement of inner tubes into the respective outer tubes.

8. The method of claim 6, wherein said expanding step includes heating the one end of each inner tube.

9. The method of claim 1, wherein said advancing step includes moving the inner tool axially of the clearance and into the outer tube.

10. The method of claim 1, further comprising the step of biasing the sheets against the one tool in the course of said rotating step.

11. The method of claim 10, wherein said biasing step includes applying against the sheet in said clearance forces acting in a direction toward the one tool at a plurality of locations which are spaced apart from each other as considered in the axial direction of the clearance.

12. The method of claim 1, further comprising the steps of moving the tools along a first path in the course of said rotating step and moving the outer tubes along a second path in the course of said advancing step.

13. The method of claim 12, wherein at least one of said paths in an endless path.

14. The method of claim 1, further comprising the step of inserting into each inner tube a cup of said material upon completion of said advancing step.

15. The method of claim 1, wherein the material of the sheets is a synthetic plastic substance.

16. The method of claim 1, wherein the axis of said clearance is at least substantially vertical.

17. The method of claim 1, wherein each outer tube contains carbon.

18. The method of claim 1, wherein the material of said sheets tends to expand radially when converted into a tube and the inner diameters of the outer tubes vary within a predetermined range, the maximum diameter of said clearance at most matching the minimum diameter of said range and further comprising the steps of restraining radial expansion of the inner tubes, at least during a portion of said advancing step, and terminating the restraining step upon completion of the advancing step so that the inner tubes are free to expand radially into contact with the internal surfaces of the respective outer tubes, said restraining step including maintaining a portion of each inner tube in the interior of the outer tool in the course of said advancing step.

19. The method of claim 18, wherein said moving step includes moving the inner tool and the inner tube axially relative to the outer tool and into the respective outer tube until the inner tube leaves the clearance and is free to expand radially, the outer tool preventing reentry of the inner tube into said clearance.

20. Apparatus for introducing inner tubes into outer tubes, comprising an outer tool having a substantially cylindrical passage; an inner tool receivable in said passage to define with said outer tool an annular clearance, said outer tool having an inlet extending substantially longitudinally of and communicating with said clearance; a source of supply of discrete sheets consisting of a flexible material; means for feeding successive sheets from said source into said clearance by way of said inlet; means for rotating one of said tools relative to the other of said tools about the axis of said clearance so that successive sheets which enter said clearance are converted into inner tubes; means for advancing successively formed inner tubes into discrete outer tubes, including a support for said inner tool, said support and said inner tool defining a shoulder which is adjacent to one end of said inner tube in said clearance and said advancing means further comprising means for reciprocating said support axially of said inner tool so that said shoulder advances the inner tubes from said clearance into the respective outer tubes while said support is moved in a direction to introduce said inner tool into the registering outer tube; and means for rotating said inner tool in a direction to unwind the inner tube which surrounds its peripheral surface while the inner tool is located in the interior of an outer tube.

21. Apparatus for introducing inner tubes into outer tubes, comprising an outer tool having a substantially cylindrical passage; an inner tool receivable in said passage to define with said outer tool an annular clearance, said outer tool having an inlet extending substantially longitudinally of and communicating with said clearance; a source of supply of discrete sheets consisting of a flexible material; means for feeding successive sheets from said source into said clearance by way of said inlet; means for rotating said inner tool relative to said outer tool about the axis of said clearance so that successive sheets which enter said clearance are converted into inner tubes, said inner tool having a roughened peripheral surface to promote the winding of sheets onto said inner tool; and means for advancing successively formed inner tubes into discrete outer tubes.

22. The apparatus of claim 21 for introducing inner tubes into outer tubes having inner diameters within a predetermined range, wherein the diameter of said passage at most equals the smallest diameter of said range and the material of said sheets tends to expand radially when the sheets are convoluted into tubes, and further comprising means for restraining complete radial expansion of inner tubes during advancement into the respective outer tubes so that each portion of an inner tube is free to expand radially into contact with the internal surface of the respective outer tube upon completed insertion into such outer tube, said restraining means forming part of said outer tool.

23. The apparatus of claim 22, wherein said restraining means includes the internal surface of said outer tool.

24. The apparatus of claim 21, wherein said source of supply includes means for subdividing an elongated web of said material into sheets each having a length sufficient to ensure its conversion into an inner tube extending along an arc of more than 360 degrees as considered in the circumferential direction of said inner tool.

25. The apparatus of claim 21, wherein said advancing means includes means for moving said inner tool in the axial direction of said clearance.

26. The apparatus of claim 21, wherein said inlet extends substantially tangentially of said clearance.

27. The apparatus of claim 21, wherein said clearance has a substantially vertical axis and further comprising first conveyor means for moving said tools along a first path and second conveyor means for moving the outer tubes along a second path.

28. The apparatus of claim 27, wherein at least one of said paths is an endless path.

29. The apparatus of claim 21, further comprising means for crimping one end portion of each inner tube prior to advancement into the respective outer tube.

30. The apparatus of claim 29, wherein said crimping means includes means for converting the one end portion of each inner tube into an inwardly extending annular collar.

31. The apparatus of claim 21, further comprising means for radially expanding one end portion of each inner tube not later than upon completed advancement into the respective outer tube.

32. The apparatus of claim 31, wherein said expanding means comprises a heated mandrel which is reciprocable into and from the one end portion of each of said succession of inner tubes.

33. The apparatus of claim 21, wherein said advancing means includes a support for said inner tool, said support and said inner tool defining a shoulder which is adjacent to one end of the inner tube in said clearance and said advancing means further comprising means for reciprocating said support axially of said inner tool so that said shoulder advances the inner tubes from said clearance into the respective outer tubes while said support is moved in a direction to introduce said inner tool into a registering outer tube.

34. The apparatus of claim 33, further comprising means for rotating said inner tool in a direction to unwind the inner tube which surrounds its peripheral surface while the inner tool is located in the interior of an outer tube.

35. The apparatus of claim 21, further comprising means for biasing the sheets in said clearance against the rotating tool to thus ensure that the rotating tool entrains the sheets into said clearance and rolls them about said inner tool.

36. The apparatus of claim 21, further comprising spring-biased means for pressing the sheets in said clearance against said one tool to thus ensure that the sheet in said clearance is wound onto said inner tool.

37. The apparatus of claim 36, wherein said one tool is said inner tool and said outer tool has at least one window communicating with said clearance, said pressing means including a pressing member extending into said window and further comprising means for urging said pressing member against the sheet in said clearance.

38. The apparatus of claim 21, further comprising means for forming cups from said material and means for inserting discrete cups into successive inner tubes upon advancement of such inner tubes into the respective outer tubes.

39. The apparatus of claim 21, wherein said outer tool includes a portion which is adjacent to successive outer tubes during advancement of inner tubes into outer tubes and is located in the path of movement of one end portion of the inserted inner tube in a direction to leave the respective outer tube so that said portion prevents movements of inner tubes out of the respective outer tubes.

* * * * *